US011187444B2

(12) United States Patent
Shen et al.

(10) Patent No.: US 11,187,444 B2
(45) Date of Patent: Nov. 30, 2021

(54) AIR-VAPOR SEPARATION DEVICE FOR SEPARATING AIR FROM REFRIGERANT VAPOR AND METHOD THEREOF

(71) Applicant: Dawning Information Industry (Beijing) Co., Ltd, Beijing (CN)

(72) Inventors: Weidong Shen, Beijing (CN); Chen Wang, Beijing (CN); Hongjie Wu, Beijing (CN); Xing Li, Beijing (CN); Jingnan Peng, Beijing (CN); Zhen Sun, Beijing (CN); Xintao Cui, Beijing (CN); Jin Chen, Beijing (CN)

(73) Assignee: Dawning Information Industry (Beijing) Co., Ltd, Beijing (CN)

( * ) Notice: Subject to any disclaimer, the term of this patent is extended or adjusted under 35 U.S.C. 154(b) by 127 days.

(21) Appl. No.: 16/608,909

(22) PCT Filed: Apr. 28, 2017

(86) PCT No.: PCT/CN2017/082332
§ 371 (c)(1),
(2) Date: Oct. 28, 2019

(87) PCT Pub. No.: WO2018/195884
PCT Pub. Date: Nov. 1, 2018

(65) Prior Publication Data
US 2021/0116157 A1 Apr. 22, 2021

(51) Int. Cl.
*F25B 43/04* (2006.01)
*F25B 31/00* (2006.01)

(52) U.S. Cl.
CPC ..... *F25B 43/043* (2013.01); *F25B 31/006* (2013.01); *F25B 2309/004* (2013.01)

(58) Field of Classification Search
CPC . F25B 43/043; F25B 31/006; F25B 2309/004
See application file for complete search history.

(56) References Cited

U.S. PATENT DOCUMENTS 2,635,436 A * 4/1953 Kogel ..... F25D 11/027 62/110
5,044,166 A * 9/1991 Wijmans ..... F25B 43/043 62/85

(Continued)

FOREIGN PATENT DOCUMENTS

CN 1791774 A 6/2006

OTHER PUBLICATIONS

International Search Report of PCT Patent Application No. PCT/CN2017/082332 dated Feb. 1, 2018.

*Primary Examiner* — David J Teitelbaum

(57) ABSTRACT

The present invention relates to an air-vapor separation device for separating air from refrigerant vapor comprising an air-vapor separation tank, a separation membrane, a mixed gas input passage, a refrigerant vapor output passage, and a control unit, wherein the mixed gas input passage is provided with a compressor and a first control valve, and the refrigerant vapor output passage is provided with a second control valve. The air-vapor separation device of the present invention has the advantages of simple structure, convenient operation, and is reliable and effective in separation of air and refrigerant vapor, with good separation effect.

7 Claims, 2 Drawing Sheets

(56) References Cited

U.S. PATENT DOCUMENTS

| | | | | |
|---|---|---|---|---|
| 5,062,273 | A * | 11/1991 | Lee | B01D 53/002 62/85 |
| 5,241,837 | A * | 9/1993 | Albertson, III | F25B 43/043 62/195 |
| 2005/0274139 | A1* | 12/2005 | Wyatt | F25B 1/00 62/498 |
| 2007/0101759 | A1* | 5/2007 | Matsuoka | F25B 43/043 62/475 |
| 2012/0180510 | A1* | 7/2012 | Okazaki | F25B 13/00 62/218 |
| 2015/0107279 | A1* | 4/2015 | Sanhaji | F25B 45/00 62/85 |
| 2016/0033184 | A1* | 2/2016 | Fountain | F25B 43/04 62/509 |
| 2020/0061529 | A1* | 2/2020 | Zhu | A23L 3/3418 |

* cited by examiner

AIR-VAPOR SEPARATION DEVICE FOR SEPARATING AIR FROM REFRIGERANT VAPOR AND METHOD THEREOF

FIELD OF THE APPLICATION

The present invention relates to the technical field of computer, in particular, to an air-vapor separation device for immersed liquid-cooling server and for separating air from refrigerant vapor, and a method thereof.

BACKGROUND OF THE APPLICATION

Most of the computers currently used rely on cold air to cool the machine, but in the data center, the air-cooling alone is not enough to meet the heat dissipation requirements for servers with high heat flux density. The traditional air-cooling mode is carried out by indirect contact cooling. It has the disadvantages of complicated heat transmission, contact thermal resistance and convection heat transfer resistance, large sum of thermal resistance, low heat transfer efficiency, large temperature difference between heat sources with high and low temperature during heat transfer, and being carried out by requiring outdoor heat sources with lower temperature to guide the heat transfer.

The liquid-cooling method uses the working fluid as a medium for intermediate heat transfer, transferring heat from the hot zone to a remote location for subsequent cooling. Since the specific heat of the liquid is much larger than that of the air, the heat dissipation speed is much larger than that of the air, so the cooling efficiency is much higher than that of the air-cooling. The water-cooling or liquid-cooling has two advantages of directly guiding coolant to the heat source instead of indirect cooling like air-cooling, and the heat transferred per unit volume, i.e., heat dissipation efficiency, being as high as 3500 times as compared with the air-cooling.

Two features of the liquid-cooling heat dissipation system are to balance CPU heat and to operate in low noise. Since the specific heat capacity of the liquid is too large, a large amount of heat can be absorbed while keeping the temperature from changing significantly and the temperature of the CPU in the liquid-cooling system can be well controlled, so that the sudden operation will not cause a sudden and significant change in the internal temperature of the CPU. Since the heat exchanger has a large surface area, it is good to use only a low-speed fan to dissipate heat. Therefore, the liquid-cooling is mostly matched with a fan with a lower rotation speed. In addition, the working noise of the pump is generally not obvious, so the overall heat dissipation system is very quiet as compared with the air-cooling system.

In terms of thermal principle, evaporative cooling is using vaporization latent heat when the refrigerant boils to take way the heat. Since the vaporization latent heat of the liquid is much larger than the specific heat, the cooling effect of evaporative cooling is more remarkable in the liquid-cooling technique.

In an immersed liquid-cooling system where phase change occurs, since the original air in the system pipeline cannot be completely discharged, and the liquid-cooling system will be brought with a part of the air during daily maintenance and replacement of spare parts, this part of the air will mix with the refrigerant vapor. And then, since the air cannot be condensed, the cooling efficiency of the liquid-cooling system will be affected. Therefore, in immersed liquid-cooling system, the air must be separated from the refrigerant vapor to remove the air from the liquid-cooling system.

SUMMARY OF THE APPLICATION

For the drawbacks of the prior art, the present invention provides an air-vapor separation device for separating air from refrigerant vapor and a method thereof, which may reliably and effectively separate air and refrigerant vapor mixed together in the liquid-cooling system.

In order to achieve the purpose of the present invention, the technical solution adopted by the present invention is to provide an air-vapor separation device for separating air and refrigerant vapor, the gas vapor separation device comprising: an air-vapor separation tank, a separation membrane, a mixed gas input passage, a refrigerant vapor output passage, and a control unit, wherein the mixed gas input passage is provided with a compressor and a first control valve, and the refrigerant vapor output passage is provided with a second control valve.

According to some embodiments of the present invention, the air-vapor separation tank includes a sealed cavity, and one side wall of the sealed cavity is the separation membrane.

According to some embodiments of the present invention, the separation membrane is in sealed connection with other side walls of the sealed cavity.

According to some embodiments of the present invention, the separation membrane is a microporous one-way filtration membrane, which may only allow the passage of the air in one direction and prevent the passage of the refrigerant vapor according to the difference in molecular size.

According to some embodiments of the present invention, the air-vapor separation tank is further provided with a pressure relief valve.

According to some embodiments of the present invention, the mixed gas input passage is provided with a nozzle at the sealed cavity of the air-vapor separation tank.

According to some embodiments of the present invention, the nozzle is selected from a chrome-plated copper alloy.

According to some embodiments of the present invention, the separation membrane is selected from a molecular sieve.

According to some embodiments of the present invention, the air-vapor separation device further comprises a detecting device for detecting a concentration of the refrigerant vapor in the sealed cavity.

In addition, the present invention also provides an air-vapor separation method using the air-vapor separation device as described above, when a mixed gas of the air-refrigerant vapor is required to separate, the control unit issues an instruction to open the first control valve on the mixed gas input passage, to close the second control valve on the refrigerant vapor output passage, and to start the compressor;

after a predetermined time period T1, the control unit issues an instruction to stop the compressor, to close the first control valve, and to stop a delivery of the mixed gas to the sealed cavity; a detecting device continuously monitors a concentration of the refrigerant vapor in the sealed cavity, and when the detecting device detects that the concentration of the refrigerant vapor is greater than or equal to a predetermined value, indicating that only refrigerant vapor remains in the sealed cavity, then, the control unit issues an instruction to open the second control valve for discharging the refrigerant vapor from the sealed cavity through the refrigerant vapor output passage.

According to some embodiments of the present invention, after the refrigerant vapor is discharged from the sealed cavity through the refrigerant vapor output passage, it is condensed by a condenser to be recovered and reused.

The air-vapor separation device according to the present invention has the advantages of simple structure, convenient operation, and is reliable and effective in separation of air and refrigerant vapor, with good separation effect. The air-vapor separation device and the method thereof according to the present invention, the air may be automatically separated from the refrigerant vapor without affecting the normal cooling of the liquid-cooling system, so that not only may the original air in the liquid-cooling system pipeline be discharged, but also may the air brought into the liquid-cooling system pipeline when repairing and replacing components be discharged for the recovery of the refrigerant, thereby greatly improving the cooling effect of the liquid-cooling system.

BRIEF DESCRIPTION OF THE ACCOMPANYING DRAWINGS

Figure 1:
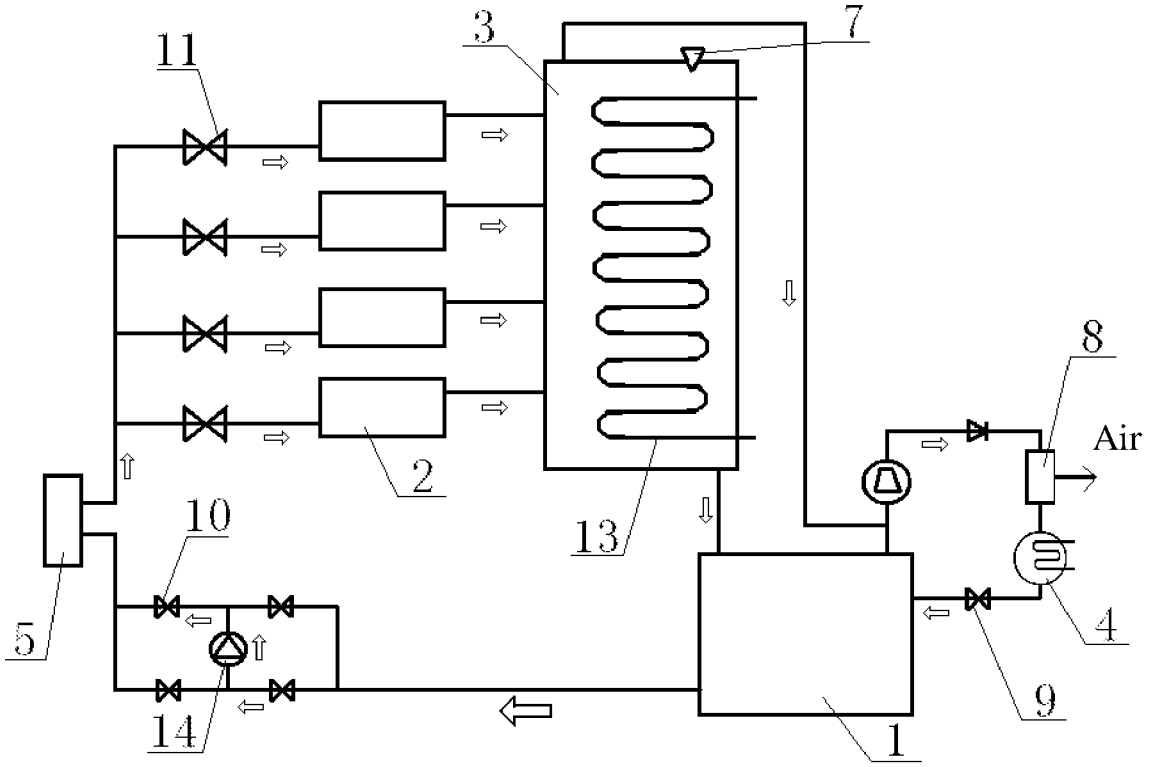
FIG. 1 illustrates a view showing the working circulation of an air-vapor separation system for immersed liquid-cooling refrigerant according to a first embodiment of the present invention.

Description of reference numerals: 1—refrigerant storage tank, 2—immersed blade cabinet, 3—first condenser, 4—second condenser, 5—drying filter, 7—first pressure relief valve, 8—air-vapor separation device, 81—air-vapor separation tank, 82—air-vapor separation membrane, 83—compressor, 84—first control valve, 85—second control valve, 9—first on-off valve, 10—second on-off valve, 11—third on-off valve, 13—condensation coil, 14—refrigerant delivery pump.

DETAILED DESCRIPTION OF THE PREFERRED EXAMPLES

To make the purpose, technical solutions and advantages of the present invention clearer, the embodiments of the present invention will be described below in detail in combination with the drawings. It should be noted that, in the case of no conflicts, the embodiments in the present invention and features in the embodiments can be combined mutually and arbitrarily.

According to an embodiment of the present invention, an immersed liquid-cooling system directly immerses a server board in a sealed cavity filled with refrigerant, and uses phase change heat transfer technology to solve the heat dissipation problem of the high-density server. Specifically, a blade server with a cabinet structure is adopted, and the blade server is a low-cost server platform for high availability and high density by inserting multiple card server units in a standard height rack cabinet (blade cabinet). The server board is installed in the blade cabinet, and all the boards are immersed in the refrigerant, and a certain space is left above the liquid surface as a gas phase zone.

As shown in FIG. 1, an immersed liquid-cooling system comprises a refrigerant storage tank 1, an immersed blade cabinet 2, a first condenser 3, an air-vapor separator 8 and a second condenser 4. The refrigerant storage tank 1 and the immersed blade cabinet 2 are sequentially connected with a refrigerant delivery pump 14 and a drying filter 5; the immersed blade cabinet 2 is connected to the first condenser 3; the first condenser 3 and the refrigerant storage tank 1 are both in communication with the air-vapor separator 8, and the air-vapor separator 8 is connected to the second condenser 4.

The immersed blade cabinet 2 is inserted with a plurality of card type server board units that are all immersed in the refrigerant. The refrigerant is an evaporative cooling medium, preferably a fluorocarbon compound that meets environmental requirements. The medium has high insulation properties and does not cause short-circuit electrical accidents like water-cooling even if it leaks out, and has a boiling temperature that can be selected according to the optimal working temperature of the chip, the boiling point being generally selected to be 30-65 degrees. A certain space is left above the liquid level of the refrigerant in the immersed blade cabinet 2 as a gas phase zone. Since the immersed cooling is adopted, the heat radiated from the heating element of the server board unit is transferred to the liquid refrigerant in the immersed blade cabinet 2 during operation, and the liquid refrigerant absorbs heat to heat up for absorbing a large amount of heat caused by boiling vaporization when the temperature reaches a corresponding saturation temperature so as to cool the heating element. The generated refrigerant vapor is diffused by the action of buoyancy to the gas phase zone above the liquid level of the refrigerant of the submerged blade cabinet 2, and the refrigerant vapor is drawn into the first condenser 3 through the air outlet line.

The first condenser 3 is a water-cooling condenser, that is, the secondary cooling medium is water. The first condenser 3 includes a sealed housing, a condensing coil 13 in the housing, and a first pressure relief valve 7, a cooling water flowing in the condensing coil 13; the housing is filled with refrigerant vapor delivered by the submerged blade cabinet 2 through the air outlet line. Since the original air in the system is usually not completely discharged, a top end of the first condenser 3 has a mixed gas of air and refrigerant vapor. An opening is provided at the top end of the first condenser 3, and the mixed gas of air and refrigerant vapor is sent into the air-vapor separator 8 via a transfer line through the opening.

The refrigerant storage tank 1 includes a first outlet, a second outlet, a first inlet, and a second inlet, and a refrigerant liquid in a liquid state is stored in the refrigerant storage tank 1. Similarly, since the original air in the system is usually not completely discharged, an upper space of the refrigerant storage tank 1 also has a mixed gas of air and refrigerant vapor. The refrigerant storage tank 1 delivers the liquid refrigerant to the submerged blade cabinet 2 via the first outlet through the refrigerant delivery pump 14. The first inlet and the second outlet are disposed at an upper portion of the refrigerant storage tank 1, wherein the first inlet receives the refrigerant liquid condensed by the first condenser 3, and the second outlet sends the mixed gas of the upper space of the refrigerant storage tank 1 into the air-vapor separator 8. The refrigerant vapor separated by the air-vapor separator 8 is condensed by the second condenser 4 and then sent back to the refrigerant storage tank 1 by the second inlet.

As shown in FIG. 1, a refrigerant delivery pump 14 and a drying filter 5 are sequentially disposed in the liquid refrigerant delivery path of the refrigerant storage tank 1 to the submerged blade cabinet 2. A first on-off valve 9 is disposed in the refrigerant return delivery path of the second condenser 4 to the refrigerant storage tank 1. The sealed housing of the first condenser 3 is provided with a first pressure relief valve 7 for automatically relieving the pressure when the pressure in the housing of the first condenser 3 exceeds a certain predetermined value to ensure safety.

The cooling cycle process of the submerged liquid-cooling system is as follows:

As shown in FIG. 1, the liquid refrigerant stored in the refrigerant storage tank 1 is pressurized by the refrigerant delivery pump 14 and dried and filtered by drying filter 5 for sending the a vertical dispenser in the cabinet, then the vertical dispenser distributes the refrigerant evenly (in this embodiment, divided into four groups) to feed into the immersed blade cabinet 2 at different vertical heights in the cabinet through the liquid inlet pipe. For the blade server in the immersed blade cabinet 2 in running, the CPU and various electronic components generate a large amount of heat, causing the liquid refrigerant to boil and undergo a phase change, from a liquid state to a gaseous state. The refrigerant vapor will gradually collect in the gas phase zone of the upper portion of the housing of the submerged blade cabinet 2 for being taken out through the outlet pipe and sent to the first condenser 3, and the refrigerant vapor surrounds the condensing coil 13 in the first condenser 3; due to the presence of the cooling water in the condensing coil 13, the refrigerant vapor is condensed in the condenser 3 into a liquid refrigerant, and is returned to the refrigerant storage tank 1 through the pipeline, thereby completing the entire cooling cycle process.

Figure 2:
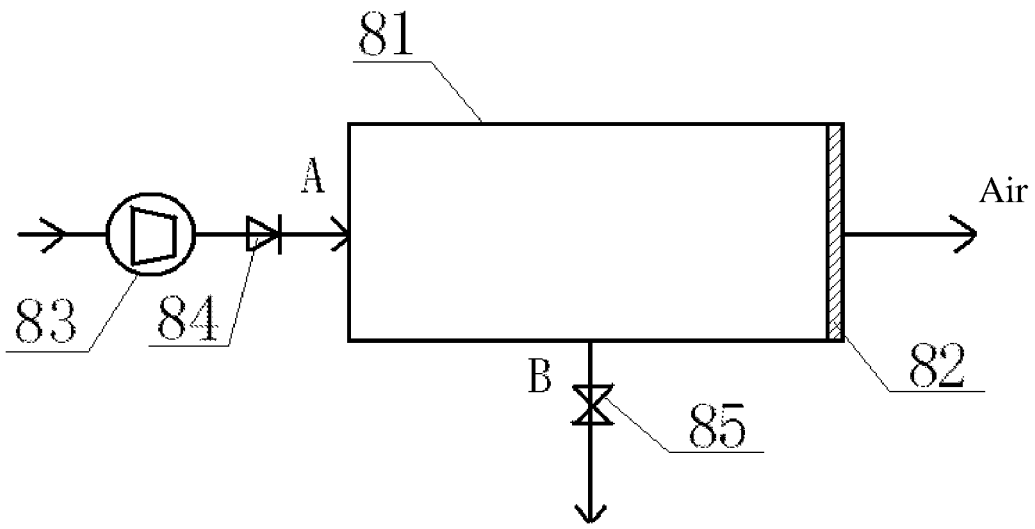
FIG. 2 illustrates a view showing the functional structure of an air-vapor separation device for immersed liquid-cooling refrigerant according to a first embodiment of the present invention.

As shown in FIG. 2, the air-vapor separation device 8 has a specific structure comprising an air-vapor separation tank 81, a separation membrane 82, a mixed gas input passage A, a refrigerant vapor output passage B, and a control unit, wherein the mixed gas input passage A is provided with a compressor 83 and a first control valve 84 thereon, and the refrigerant vapor output passage B is provided with a second control valve 85 thereon.

The air-vapor separation tank 81 includes a sealed cavity, and one side wall of the sealed cavity is the separation membrane 82; the separation membrane 82 is in sealed connection with other side walls of the sealed cavity; the separation membrane 82 is a microporous one-way filtration membrane, which may only allow the passage of the air in one direction and prevent the passage of the refrigerant vapor according to the difference in molecular size. The separation membrane 82 may be considered to select a corresponding molecular sieve according to the molecular particle size range of the refrigerant vapor and the air. Further, the air-vapor separation tank 81 is further provided with a pressure relief valve thereon for relieving the pressure when the pressure in the sealed cavity exceeds a predetermined value to ensure safety of the apparatus.

The mixed gas input passage A is provided with a nozzle at the sealed cavity of the air-vapor separation tank 81 to increase the injection speed of the mixed gas into the sealed cavity, and the nozzle is selected from a chrome-plated copper alloy.

Moreover, the air-vapor separation tank 81 is further provided with a pressure relief valve thereon for relieving the pressure when the pressure in the air-vapor separator exceeds a certain predetermined value.

The working process of the air-vapor separation device 8 is as follows:

When the mixed gas of the air-refrigerant vapor is required to separate, the control unit issues an instruction to open the first control valve 84 on the mixed gas input passage A, to close the second control valve 85 on the refrigerant vapor output passage B, and to start the compressor 83; the mixed gas is sprayed into the sealed cavity at a high speed from the nozzle at a constant pressure P, the mixed gas flowing in the sealed cavity at a high speed, and the molecular particle size of the air in the mixed gas is smaller than the pore diameter in the separation membrane 82 for being discharged to the outside of the sealed cavity through the separation membrane 82, wherein the molecular particle size of the refrigerant vapor in the mixed gas is larger than the pore diameter of the separation membrane 82 for being prevented from passing through the separation membrane 82 and being retained in the sealed cavity; after a certain period of time T1, the control unit issues an instruction to stop the compressor 83 and to close the first control valve 84, and the delivery of the mixed gas to the sealed cavity is stopped; then, the detecting device continuously monitors the concentration of the refrigerant vapor in the sealed cavity, and after continuing for a period of time T2, the detecting device detects that the concentration of the refrigerant vapor is 99.9% or more, indicating that the air has been completely discharged to the outside of the sealed cavity through the separation membrane 82 while only refrigerant vapor remaining in the sealed cavity, and the air is successfully separated from the refrigerant vapor in the mixed gas; at this time, the control unit issues an instruction to open the second control valve 85, and the refrigerant vapor is discharged into the sealed cavity through the refrigerant vapor output passage B for being condensed by the second condenser 4 and being recycled and reused; subsequently, after the refrigerant vapor is completely discharged from the sealed cavity, the control unit re-issues an instruction to open the first control valve 84 on the mixed gas input passage A and to close the second control valve 85 on the refrigerant vapor output passage B while activating the compressor 83 to enter the next working cycle.

The technical means adopted by the above embodiment for discharging the air from the sealed cavity while retaining the refrigerant vapor in the sealed cavity separates the mixed gas of the air-refrigerant vapor. Of course, the separation membrane 82 through which the refrigerant vapor may pass may also be used, thereby separating the mixed gas by leaving the air in the sealed cavity while discharging the refrigerant vapor, and having a separation effect that may also be achieved, which will not be described in detail.

The air-vapor separation device and method of the invention has the advantages of simple structure, convenient operation, and is reliable and effective in separation of air and refrigerant vapor, with good separation effect.

While the embodiments of the present invention have been described above, the described embodiments are merely illustrative of the embodiments of the present invention, and are not intended to limit the present invention. Any modification and variation in the form and details of the embodiments may be made by those skilled in the art without departing from the spirit and scope of the invention, and maybe ought to fall within the scope of protection of the present application.

What is claimed is:

1. An air-vapor separation device for separating air and refrigerant vapor, characterized in that, comprising an air-vapor separation tank, a separation membrane, a mixed gas input passage, a refrigerant vapor output passage, and a control unit, wherein the mixed gas input passage is provided with a compressor and a first control valve, and the refrigerant vapor output passage is provided with a second control valve;

wherein the air-vapor separation tank includes a sealed cavity, and the air-vapor separation device further comprises a detecting sensor for detecting a concentration of the refrigerant vapor in the sealed cavity;

when a mixed gas of the air-refrigerant vapor is required to separate, the control unit issues an instruction to open the first control valve on the mixed gas input passage, to close the second control valve on the refrigerant vapor output passage, and to start the compressor;

after a predetermined time period, the control unit issues an instruction to stop the compressor, to close the first control valve, and to stop a delivery of the mixed gas to the sealed cavity;

the detecting sensor continuously monitors the concentration of the refrigerant vapor in the sealed cavity, and when the detecting sensor detects that the concentration of the refrigerant vapor is greater than or equal to a predetermined value, indicating that only refrigerant vapor remains in the sealed cavity, then, the control unit issues an instruction to open the second control valve for discharging the refrigerant vapor from the sealed cavity through the refrigerant vapor output passage.

2. The air-vapor separation device according to claim 1, characterized in that, side wall of the sealed cavity is the separation membrane.

3. The air-vapor separation device according to claim 2, characterized in that, the separation membrane is in sealed connection with other side walls of the sealed cavity.

4. The air-vapor separation device according to claim 1, characterized in that, the separation membrane is a microporous one-way filtration membrane, which may only allow the passage of the air in one direction and prevent the passage of the refrigerant vapor according to the difference in molecular size.

5. The air-vapor separation device according to claim 1, characterized in that, the air-vapor separation tank is further provided with a pressure relief valve.

6. The air-vapor separation device according to claim 1, characterized in that, the separation membrane is selected from a molecular sieve.

7. An air-vapor separation method using the air-vapor separation device accordingly to claim 1, characterized in that, after the refrigerant vapor is discharged from the sealed cavity through the refrigerant vapor output passage, it is condensed by a condenser to be recovered and reused.

* * * * *